US011440323B2

(12) United States Patent
Hori

(10) Patent No.: US 11,440,323 B2
(45) Date of Patent: Sep. 13, 2022

(54) ELECTRONIC APPARATUS AND PRINTING DEVICE

(71) Applicant: CASIO COMPUTER CO., LTD., Tokyo (JP)

(72) Inventor: Masahiro Hori, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 42 days.

(21) Appl. No.: 16/902,649

(22) Filed: Jun. 16, 2020

(65) Prior Publication Data

US 2020/0398573 A1 Dec. 24, 2020

(30) Foreign Application Priority Data

Jun. 24, 2019 (JP) ..... JP2019-116095

(51) Int. Cl.
*B41J 2/165* (2006.01)
*A45D 29/00* (2006.01)

(52) U.S. Cl.
CPC ..... *B41J 2/16547* (2013.01); *B41J 2/16505* (2013.01); *B41J 2/16517* (2013.01); *B41J 2/16538* (2013.01); *A45D 2029/005* (2013.01)

(58) Field of Classification Search
CPC ..... B41J 2/16547; B41J 2/16505; B41J 2/16517; B41J 2/16538; A45D 2029/005
See application file for complete search history.

(56) References Cited

U.S. PATENT DOCUMENTS 6,390,595 B1 5/2002 Kusumi
9,216,580 B2 12/2015 Higuchi
9,393,789 B2 7/2016 Higuchi
9,623,663 B2 4/2017 Higuchi
9,873,257 B2 1/2018 Higuchi
(Continued)

FOREIGN PATENT DOCUMENTS

CN 107443909 A 12/2017
JP H1158754 A 3/1999
(Continued)

OTHER PUBLICATIONS

Machine English translation of CN 107443909A (Year: 2017).*
(Continued)

*Primary Examiner* — Sharon Polk
(74) *Attorney, Agent, or Firm* — Holtz, Holtz & Volek PC

(57) ABSTRACT

An electronic apparatus includes a mobile object, a moving mechanism, and a functional mechanism. The mobile object has a first contact member and performs a moving operation within a drawing area and a set drawing operation on a drawing medium. The moving mechanism moves the mobile object. The functional mechanism has a portion located within the drawing area and takes a standby state and a function exercised state in which a set function is exercised. The functional mechanism includes a movable portion having a second contact member. In an abutting state where the first contact member and the second contact member come into contact with each other outside the drawing area, the mobile object moves along a movable direction of the movable portion so that the movable portion moves to bring the functional mechanism into the function exercised state.

4 Claims, 6 Drawing Sheets

(56) References Cited

U.S. PATENT DOCUMENTS

| | | | | |
|---|---|---|---|---|
| 10,252,533 | B2 | 4/2019 | Higuchi | |
| 10,576,746 | B2 | 3/2020 | Higuchi | |
| 2013/0050333 | A1 | 2/2013 | Tanaka et al. | |
| 2014/0060560 | A1* | 3/2014 | Bitoh | A45D 29/00 132/73 |
| 2018/0215156 | A1* | 8/2018 | Shimada | B41J 2/16511 |
| 2019/0090609 | A1 | 3/2019 | Shimizu | |
| 2020/0113306 | A1 | 4/2020 | Shimizu | |

FOREIGN PATENT DOCUMENTS

| | | | | | |
|---|---|---|---|---|---|
| JP | 2004142190 | A | | 5/2004 | |
| JP | 2007021726 | A | | 2/2007 | |
| JP | 2013049201 | A | | 3/2013 | |
| JP | 2013158983 | A | * | 8/2013 | |
| JP | 2013158983 | A | | 8/2013 | |
| JP | 2015196266 | A | | 11/2015 | |
| JP | 2019059118 | A | | 4/2019 | |
| JP | 2019118663 | A | * | 7/2019 | B41J 2/16588 |

OTHER PUBLICATIONS

Japanese Office Action (and English language translation thereof) dated Jan. 4, 2022, issued in counterpart Japanese Application No. 2019-116095.

Chinese Office Action (and English language translation thereof) dated Oct. 8, 2021, issued in counterpart Chinese Application No. 202010571988.2.

* cited by examiner

ELECTRONIC APPARATUS AND PRINTING DEVICE

CROSS REFERENCE TO RELATED APPLICATION

This application is based upon and claims the benefit of priority under 35 USC 119 of Japanese Patent Application No. 2019-116095 filed on Jun. 24, 2019, the entire disclosure of which, including the description, claims, drawings and abstract, is incorporated herein by reference in its entirety.

BACKGROUND OF THE INVENTION

1. Field of the Invention

The present invention relates to an electronic apparatus and a printing device.

2. Description of Related Art

Conventionally, an ink jet printing device is known which discharges ink as fine droplets from an ink discharge surface of a print head to perform printing on a printing target.

Such an ink jet printing device is generally provided with a cap mechanism that covers or otherwise protects the ink discharge surface of the print head when printing is not performed.

Such a printing device is also provided with a maintenance mechanism that performs various types of maintenance for the ink discharge surface of the print head (for example, see JP 2007-021726A).

However, various functional components such as the cap mechanism and maintenance mechanism may, for example, interrupt the ink discharge surface during a printing operation.

Thus, such functional components are conventionally arranged at a position at which they may not interrupt the print head during a printing operation, for example, on the outside of a printing area, such as the rear side of the device.

SUMMARY OF THE INVENTION

To achieve at least one of the abovementioned objects, according to an aspect of the present invention, an electronic apparatus includes:

a mobile object that has a first contact member and performs a moving operation within a drawing area and a set drawing operation on a drawing medium;

a moving mechanism that moves the mobile object; and a functional mechanism that has at least a portion located within the drawing area and takes a standby state and a function exercised state in which a set function is exercised, wherein the functional mechanism includes a movable portion having a second contact member that comes into contact with the first contact member, and in an abutting state where the first contact member and the second contact member come into contact with each other outside the drawing area, the mobile object moves along a movable direction of the movable portion so that the movable portion moves to bring the functional mechanism into the function exercised state.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF THE PREFERRED EMBODIMENT

An embodiment of an electronic apparatus (a printing device) according to the present invention will be described with reference to FIG. 1 to FIG. 9.

Although the embodiment which will be described below has various limitations that are technologically preferable for carrying out the present invention, the scope of the present invention is not intended to be limited to the following embodiment and illustrated examples.

In the following embodiment, a case in which the printing device is a nail printing device that performs printing on the nail of a finger as a printing target will be described as an example, but the printing target of the printing device in the present invention is not limited to the nail of a finger. The printing target may be the nail of a toe, for example. The printing target may be anything other than the nail, such as the surface of an artificial nail tip or various accessories.

Figure 1:
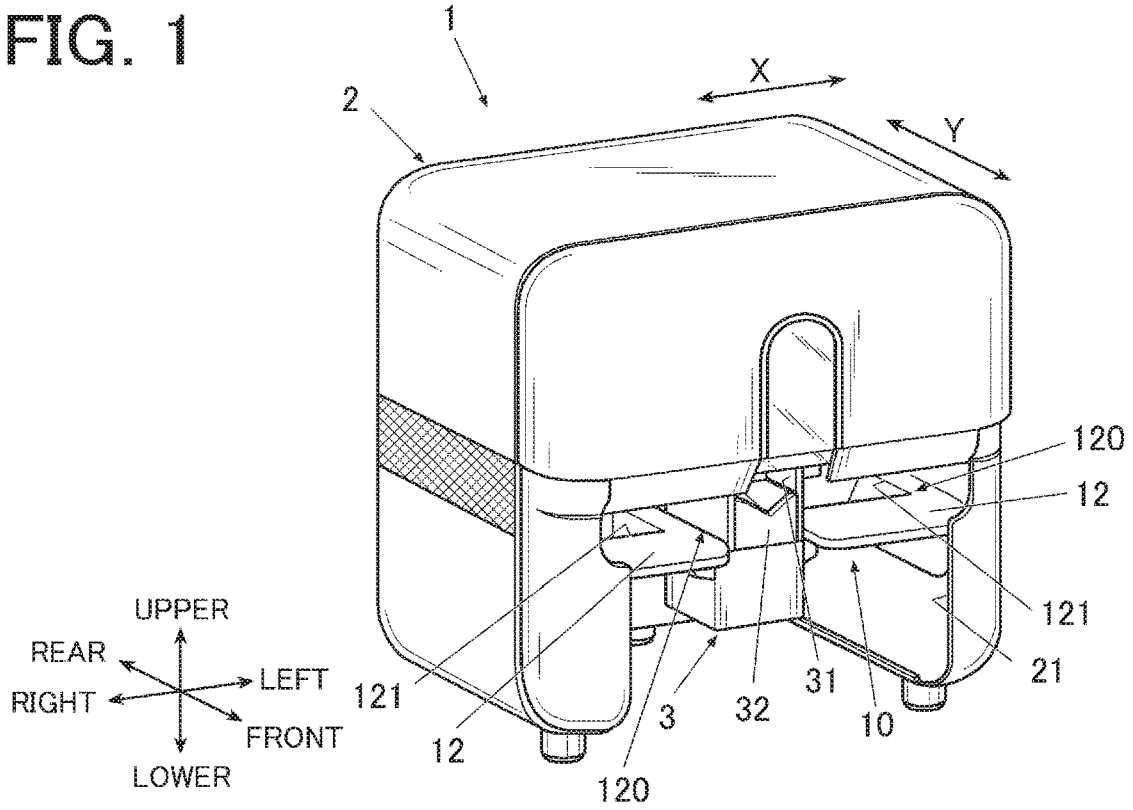
FIG. 1 is a perspective view showing an appearance of a nail printing device in the present embodiment.

FIG. 1 is a perspective view showing an appearance structure of a nail printing device 1 which is the printing device in the present embodiment.

In the following embodiment, upper, lower, left, right, front, and rear shall refer to orientations shown in FIG. 1. An X-direction and a Y-direction shall refer to directions shown in FIG. 1.

As shown in FIG. 1, the nail printing device 1 has a substantially box-shaped housing 2 and a device main body (electronic apparatus) accommodated in the housing 2.

The housing 2 has an opening 21 on the front surface side (the front surface side of the nail printing device 1 which is the front side in FIG. 1).

In the present embodiment, substantially the lower half in the height direction of the housing 2 serves as the opening 21, and a finger having the nail which is a printing target and other waiting fingers (neither fingers nor nails are shown) are inserted into the device through this opening 21.

The shape, structure, and the like of the housing 2 are not limited to those of the illustrated example, but can be set as appropriate. For example, a power switch button that powers on/off the nail printing device 1, various displays, and the like may be provided on the upper surface, a side surface, and the like of the housing 2.

Figure 2:
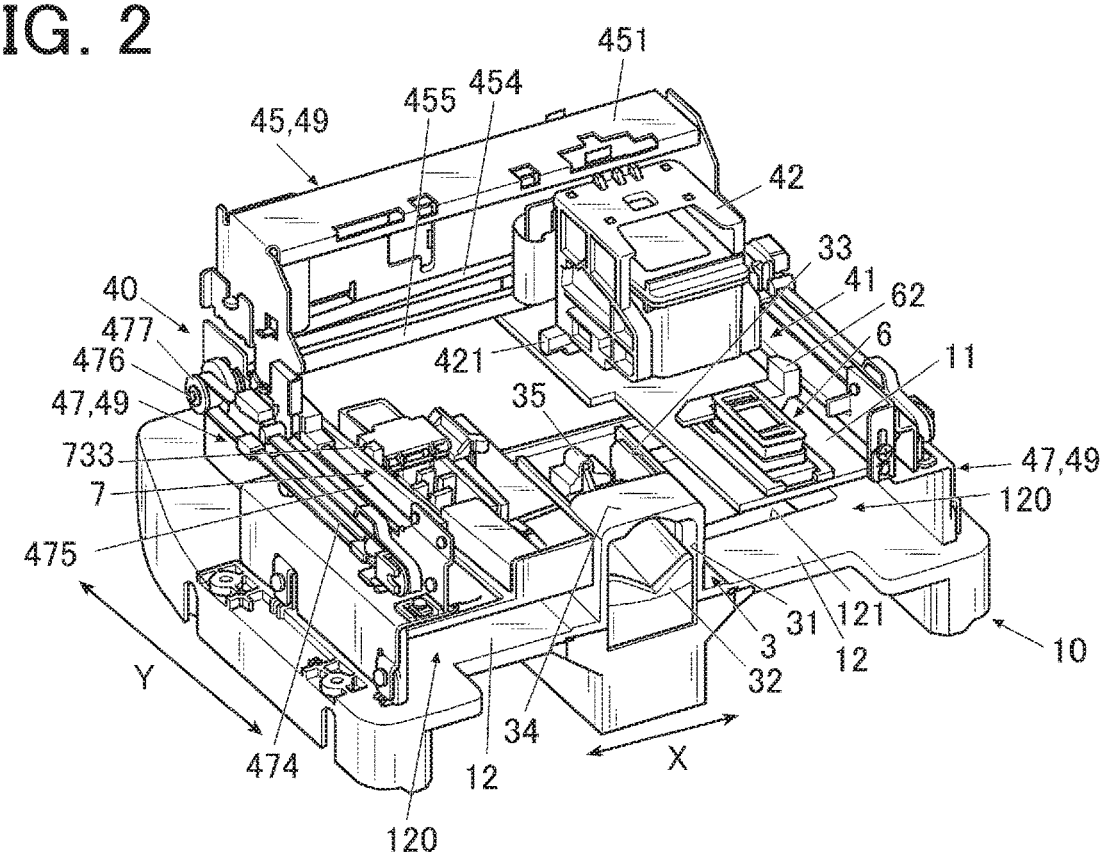
FIG. 2 is a perspective view showing an inner structure of the nail printing device shown in FIG. 1.

FIG. 2 is a perspective view of an essential part, showing an inner structure of the nail printing device with the housing removed from the nail printing device shown in FIG. 1.

As shown in FIG. 2, a base board 10 with various inner structural objects incorporated therein is provided within the housing 2. In the present embodiment, the device main body in which the various inner structural objects are incorporated into the base board 10 constitutes the electronic apparatus.

A substantially flat base board upper plate 11 is arranged above the base board 10. The base board upper plate 11 is arranged at a height substantially flush with the surface of a nail (a printing target surface) in a state where a to-be-printed finger (a finger corresponding to the nail on which printing is to be performed) is fixed on a finger fixing part 3. This base board upper plate 11 divides a portion on at least the left and right sides of the finger fixing part 3 into an upper area and a lower area with respect to the arranged height.

The finger fixing part 3 is arranged at a front side (near side) portion of the base board upper plate 11 and at the substantially central part in the left-right direction. That is, the base board upper plate 11 is provided at a portion including both the left and right sides of the finger fixing part 3.

The finger fixing part 3 is a box-shaped member having an opening 31 that opens to the front surface side of the device, and a finger fixing member 32 that fixes a to-be-printed finger is arranged within the finger fixing part 3.

The finger fixing member 32 is to push up and support a finger to be printed from below, and is made of resin having flexibility, for example. In the present embodiment, the finger fixing member 32 has a recessed shape substantially at the central part in the widthwise direction (the left-right direction), and when a to-be-printed finger is mounted on the finger fixing member 32, the finger fixing member 32 receives the ball of the to-be-printed finger to prevent the finger from jiggling in the left-right direction.

The far side of the top surface of the finger fixing part 3 (the rear side in the Y-direction) serves as an opening 33. The nail of the finger inserted into the finger fixing part 3 is exposed at the opening 33.

In the present embodiment, printing (a set operation) is performed with a printer 40 which will be described later in an area where the opening 33 is provided, and a set area including this area is a printing area (operation area) Ar1. The printing area Ar1 is an area where the print head 41 (and a head holder 42 that holds this) can move when printing is performed on the nail of a finger with the print head 41, and is wider than the opening 33 at which the nail as a printing target is located and exposed.

The near side of the top surface of the finger fixing part 3 (the front side in the Y-direction) serves as a finger press 34 that prevents a to-be-printed finger from floating to restrict the upper position of the to-be-printed finger.

With the to-be-printed finger being supported by the finger fixing member 32 from below, and the upper side of the to-be-printed finger being pressed by the finger press 34, the position in the height direction of the surface of the nail of the to-be-printed finger (printing target surface) is located at a set position suitable for performing printing with the printer 40.

Below the base board upper plate 11 and below the opening 31, a mounting plate 12 on which fingers not to be printed (fingers other than the to-be-printed finger, that is, the first finger, third finger, and the like of the right hand in a case where the second finger of the right hand is the to-be-printed finger, for example) are mounted during printing is provided substantially in parallel to the base board upper plate 11. A finger input part 121 having a recessed or hole-like shape is formed in the mounting plate 12. This finger input part 121 is formed at a position on the far side (rear side) corresponding to the tip side portions of mounted fingers not to be printed.

A space on both the left and right sides of the finger fixing part 3 in the housing 2 and between the base board upper plate 11 and the mounting plate 12 serves as a finger waiting part 120 in which the fingers not to be printed wait while printing is being performed on the nail of the to-be-printed finger.

During printing, a user inserts the waiting fingers not to be printed into the finger waiting part 120, and inserts the fingertips into the finger input part 121 as appropriate, so that the fingers not to be printed are held in a stable state effortlessly. Thus, the to-be-printed finger is not strained, and a shake or the like is less likely to occur during printing.

Since the fingertips of the fingers not to be printed are inserted into the finger input part 121, the nail of a finger on which printing has been terminated, for example, is prevented from coming into contact with the respective parts of the device. Accordingly, the printed nail may not be scraped or damaged, and a stain is prevented from adhering to the inside of the device.

A space below the base board upper plate 11 including a space below the mounting plate 12 may be used as a finger waiting part. Furthermore, the finger waiting part 120 should only be a space on both the left and right sides of the finger fixing part 3 within the housing 2.

On both the sides of the finger fixing part 3 on the base board upper plate 11, a cap mechanism 6 for protecting an ink discharge surface 411 (see FIG. 3) of the print head 41 which will be described later from drying and the like when printing is not performed, a maintenance mechanism 7 that performs maintenance such as cleaning of the ink discharge surface 411 of the print head 41 when printing is not performed, and the like are provided.

In the present embodiment, as shown in FIG. 2, the cap mechanism 6 is arranged on the right side in the widthwise direction (the X-direction) in the device, and the maintenance mechanism 7 is arranged on the left side.

In the present embodiment, the cap mechanism 6 and the maintenance mechanism 7 each have a movable portion as will be described later, and are functional components that have at least a portion located within the printing area Ar1, and may take a standby state and a function exercised state in which a set function is exercised.

As shown in FIG. 2, the printer 40 that performs printing on the printing target surface is provided within the housing 2. The printing target surface is the surface of a printing target, which is the surface of the nail of a finger in the present embodiment.

The printer 40 includes:

the print head 41;

the head holder 42 that supports the print head 41;

an X-direction moving mechanism 45 including an X-direction moving motor not shown and the like for moving the print head 41 in the X-direction along the left-right direction; and Y-direction moving mechanisms 47 each including a Y-direction moving motor not shown and the like for moving the print head 41 in the Y-direction along the front-rear direction.

The Y-direction moving mechanisms 47 are provided on both sides in the left-right direction (the X-direction) on the base board upper plate 11 in a manner extending in the front-rear direction (the Y-direction). The Y-direction moving mechanisms 47 on the left and right sides of the device are respectively provided with driving belts 474 wound around pulleys 477 provided on both ends in the front-rear direction (the Y-direction) of the Y-direction moving mechanisms 47, and extending in the front-rear direction.

The pulleys 477 provided on the rear side of the device are attached to both ends of the driving shaft 476. The Y-direction moving motor is connected to this driving shaft 476. When this Y-direction moving motor is driven, the driving shaft 476 and the pulleys 477 attached thereto rotate in the forward/rearward direction as appropriate.

The X-direction moving mechanism 45 is provided on the rear end of the base board upper plate 11, and includes a carriage 451 having a rectangular box shape extending in the left-right direction (the X-direction) of the device.

Guide shafts 475 extending in the front-rear direction in parallel to the driving belts 474 are inserted through both the left and right ends of the X-direction moving mechanism 45. When the Y-direction moving motor is driven and the driving belts 474 rotate, this X-direction moving mechanism 45 (the carriage 451 of the X-direction moving mechanism 45 and the print head 41 mounted on the carriage 451) is movable in the Y-direction along the guide shaft 475.

A pulley not shown is provided on the inner side of the carriage 451, and a driving belt 454 extending in the left-right direction is wound around this pulley. A guide shaft 455 extending in the left-right direction substantially in parallel to this driving belt 454 is also provided on the inner side of the carriage 451.

The head holder 42 is mounted on the carriage 451 of the X-direction moving mechanism 45.

A holder support member 423 through which the guide shaft 455 is inserted is provided on the back side of the head holder 42 (the rear side in FIG. 2).

When the X-direction moving motor is driven and the driving belt 454 rotates, the head holder 42 moves within the carriage 451 of the X-direction moving mechanism 45 in the X-direction along the guide shaft 455.

In the present embodiment, the X-direction moving motor of the X-direction moving mechanism 45, the Y-direction moving motor of the Y-direction moving mechanism 47, and the like constitute a moving mechanism (which will be hereinafter referred to as a "head moving mechanism 49") that moves the print head 41 (the head holder 42 that holds the print head 41) in the X-direction and the Y-direction. Operations of the head moving mechanism 49 and the print head 41 are controlled by a control device not shown.

Specifically, the X-direction moving motor, the Y-direction moving motor, and the like of the head moving mechanism 49 are driven as appropriate in accordance with the control exerted by the control device to move the print head 41 (the head holder 42 that holds the print head 41) in the X-direction and the Y-direction. Ink discharge control for the print head 41 and the like in accordance with the control exerted by the control device are performed.

In this manner, the moving mechanism (the head moving mechanism 49) of the present embodiment is a two-axis moving mechanism that moves the print head 41 which is a mobile object which will be described later in a first direction (for example, the X-direction) and a second direction (for example, the Y-direction) crossing the first direction.

Figure 3:
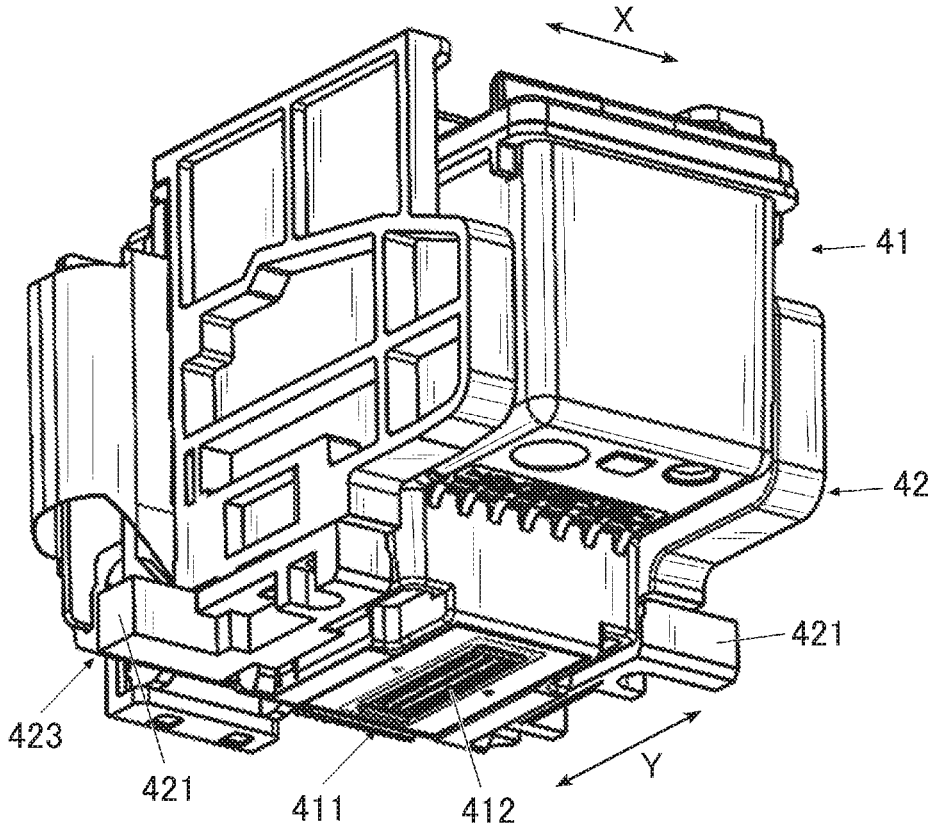
FIG. 3 is a perspective view showing a structure of a print head and a holder in the present embodiment.

FIG. 3 is a perspective view in a case where the print head and the head holder that holds this are seen from diagonally below on the front side.

In the present embodiment, the print head 41 and the head holder 42 that holds this are mobile objects that perform a printing operation while moving within the set printing area Ar1 (see FIG. 7 to FIG. 9 which will be described later).

As shown in FIG. 3, the ink discharge surface 411 from which ink is discharged through a plurality of nozzle discharge ports 412 arranged in rows is provided on the lower surface of the print head 41 of the present embodiment.

The print head 41 is an ink jet head of an ink jet system that performs printing by spraying ink in the form of fine droplets to a to-be-printed surface of a printing target (nail) from the ink discharge surface 411. The print head 41 is capable of discharging ink of yellow (Y), magenta (M), and cyan (C), for example.

The print head 41 is configured to move in an area above the base board upper plate 11.

The head holder 42 has a first engagement part (first contact member) 421 protruding from the outer periphery of the main body of the head holder 42.

In the present embodiment, the first engagement parts 421 each having a protrusion shape are provided on the lower end of both sides of the head holder 42 in a manner protruding in the lateral direction (the X-direction).

As will be described later, the first engagement part 421 protruding to the right side in the lateral direction (the X-direction) (the right side in FIG. 2 and FIG. 3) is engageable with a second engagement part (second contact member) 62 (see FIG. 4) of the cap mechanism 6, and is provided on the front side (see FIG. 3) in the front-rear direction (the Y-direction) of the head holder 42. The first engagement part 421 protruding to the left side in the lateral direction (the X-direction) (the left side in FIG. 2 and FIG. 3) is engageable with (abuttable on) a second engagement part (second contact member) 733 (see FIG. 5) of the maintenance mechanism 7, and is provided on the rear side (see FIG. 3) in the depth direction (the Y-direction) of the head holder 42.

As described earlier, the holder support member 423 is provided on the back side of the head holder 42, and the guide shaft 455 extending in the X-direction is inserted through the holder support member 423.

A side of the finger fixing part 3 on the base board upper plate 11 serves as a home position Ar2 where the print head 41 is located when printing is not performed.

In the present embodiment, the right side in the X-direction of the device serves as the home position Ar2. The home position Ar2 should only be located within a range where the print head 41 (the head holder 42 that holds the print head 41) is moved by the head moving mechanism 49, and may be on the left side in the X-direction of the device, for example.

At the home position Ar2, the cap mechanism 6 that covers the ink discharge surface 411 on the lower surface of the print head 41 is provided.

Figure 4:
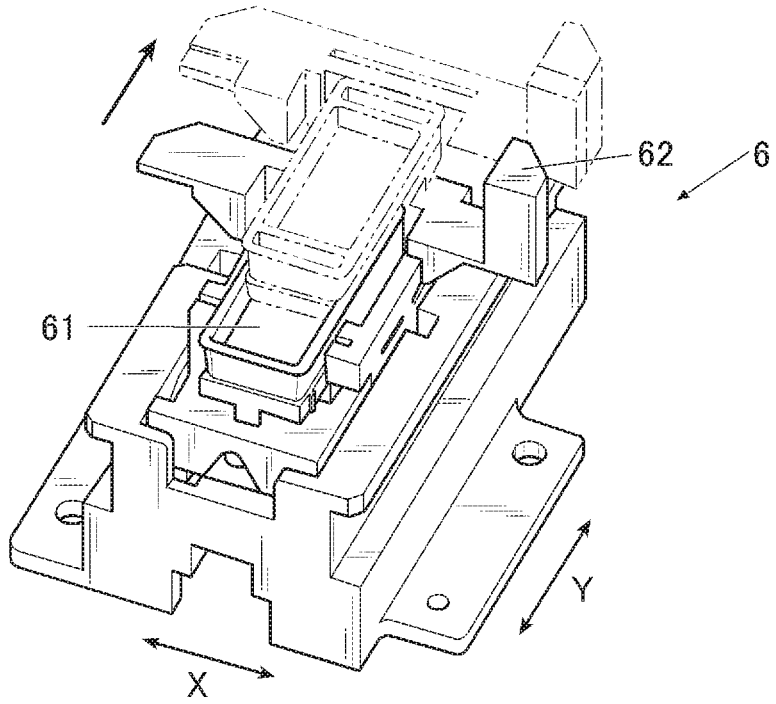
FIG. 4 is a perspective view showing a structure of a cap mechanism in the present embodiment.

FIG. 4 is a perspective view showing the cap mechanism in the present embodiment. In FIG. 4, an initial state (standby state) is shown by solid lines, and the function exercised state in which a set function which will be described later is exercised is shown by chain double-dashed lines.

The cap mechanism 6 is a functional component that protects the ink discharge surface 411 from drying and the like when printing is not performed, and includes a cap 61 that covers and caps the lower surface of the print head 41. The cap 61 is made of flexible resin or the like, for example.

In the cap mechanism 6, the cap 61 is a first movable portion, and the cap 61 moves in the front-rear direction (that is, the Y-direction) of the device which is a movable direction.

As shown in FIG. 4, the cap 61 is integrally provided with the second engagement part 62.

In the present embodiment, the second engagement part 62 is provided on the far side of the device on the cap 61 in a manner extending to the right side in the X-direction, with its free end protruding upward. In a case where the cap mechanism 6 is arranged on the left side in the X-direction contrarily to the present embodiment, the second engagement part 62 is also provided on the left side in the X-direction on the cap 61.

The second engagement part 62 is engaged with the first engagement part 421 provided on the head holder 42 of the print head 41 which is a mobile object outside the printing area (operation area) Ar1.

The cap 61 is biased by a biasing member (not shown) having a spring or the like toward the front side in the Y-direction when in the initial state (standby state) in which the print head 41 is not covered (the state shown by solid lines in FIG. 4, for example). In this state, the upper surface of the cap 61 has been lowered to a sufficiently low position to a degree not coming into contact with the lower surface of the print head 41 (that is, the ink discharge surface 411).

In the present embodiment, at least a portion of the cap mechanism 6, such as the cap 61, is located within the printing area Ar1, and it is structured such that the cap 61 or the like neither comes into contact with the print head 41 nor interrupts the movement of the print head 41 during printing when the cap 61 is lowered to such a low position in the standby state.

Figure 7:
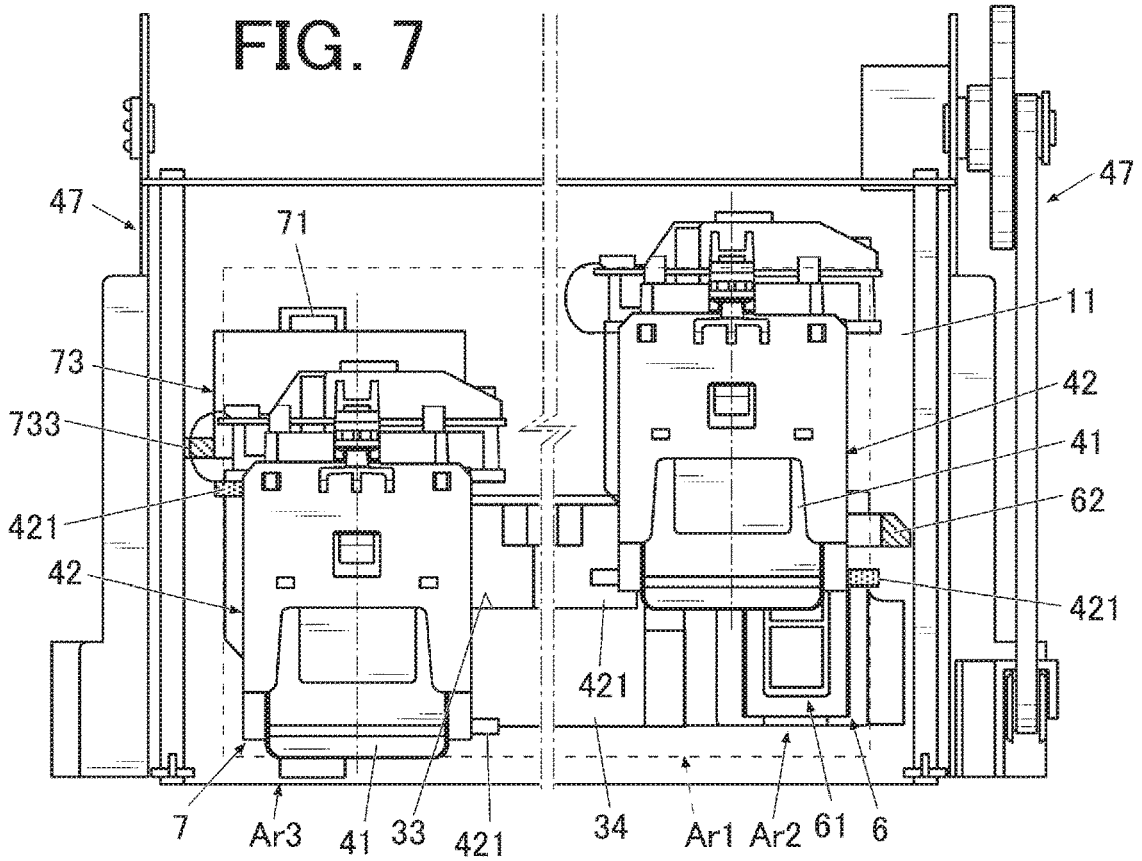
FIG. 7 is a plan view representing a relationship with a cap mechanism on the right side and a relationship with a maintenance mechanism on the left side, and schematically showing a state in which a first engagement part and a second engagement part are not engaged with each other.

FIG. 7 is a drawing showing a state in which the first engagement part of the print head (the head holder that holds the print head) which is a mobile object is not engaged with the second engagement part. FIG. 8 is a drawing showing a state in which the first engagement part of the print head (the head holder that holds the print head) which is a mobile object is engaged with the second engagement part.

Figure 8:
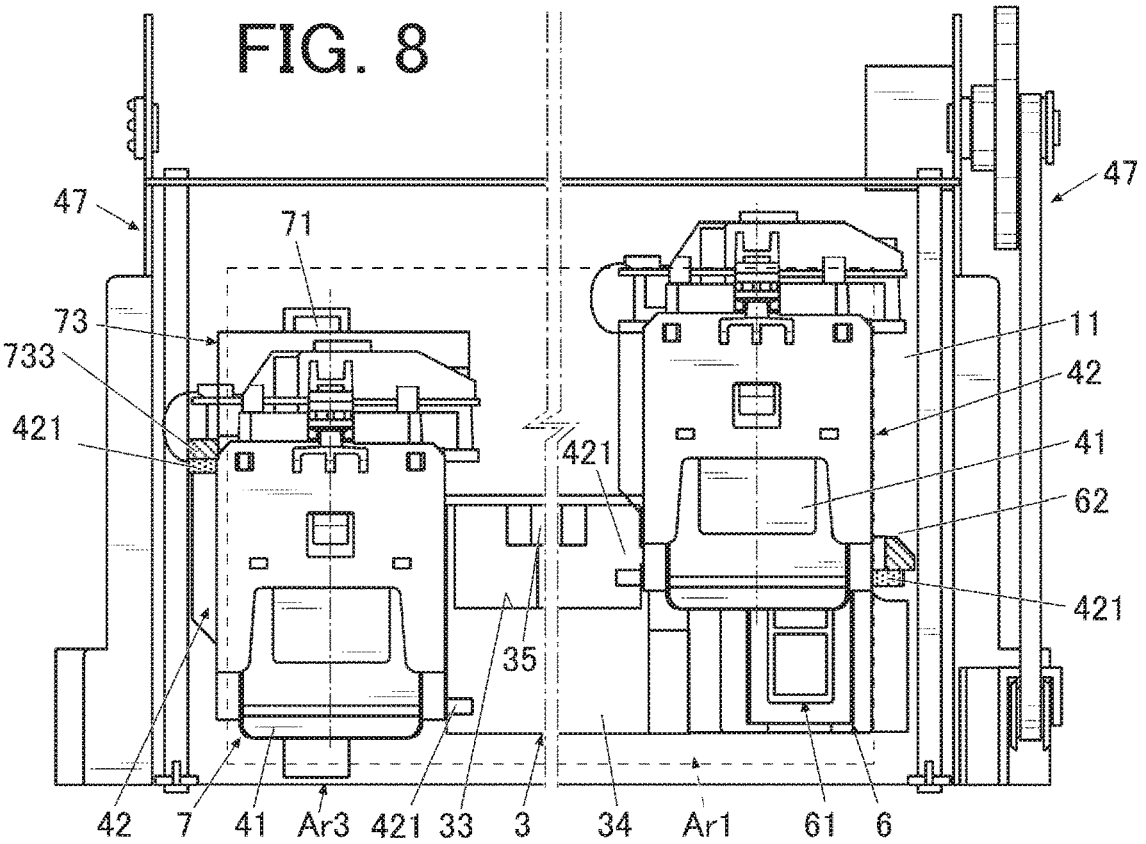
FIG. 8 is a plan view representing a relationship with the cap mechanism on the right side and a relationship with the maintenance mechanism on the left side, and schematically showing a state in which the first engagement part and the second engagement part are engaged with each other.

Although FIG. 7 and FIG. 8 depict as if two print heads 41 and two head holders 42 are arranged in one drawing for the sake of illustration, the nail printing device 1 which is a printing device includes the print head 41 and the head holder 42 one each. The right side with respect to the break line in FIG. 7 and FIG. 8 illustrates a state in which the print head 41 and the head holder 42 are located at the home position Ar2, and the left side with respect to the break line in FIG. 7 and FIG. 8 illustrates a state in which the print head 41 and the head holder 42 are located in a maintenance area Ar3 which will be described later.

Even when moving in the Y-direction, the print head 41 (the head holder 42 that holds the print head 41) which is a mobile object does not run into the second engagement part 62 as long as the first engagement part 421 substantially as a whole is present within the printing area Ar1 (see the right side in FIG. 7, for example).

Then, when the print head 41 (the head holder 42 that holds the print head 41) which is a mobile object moves in the right direction along the X-direction which is the first direction, and moves from the front side to the rear side in the Y-direction which is the second direction crossing the first direction in a state where at least the first engagement part 421 substantially as a whole is located outside the printing area Ar1 (in the present embodiment, on the right side in the X-direction with respect to the printing area Ar1), the first engagement part 421 runs into the second engagement part 62 to be brought into an engaged state (abutting state) (see the right side in FIG. 8, for example).

When the print head 41 (the head holder 42 that holds the print head 41) further moves to the rear side of the device along the Y-direction which is the second direction while maintaining this engaged state, the cap mechanism 6 which is a functional component is brought into the function exercised state.

That is, the first engagement part 421 of the mobile object (the print head 41 and the head holder 42 that supports this) pushes the second engagement part 62 of the cap mechanism 6 toward the rear side in the Y-direction, and accordingly, the cap 61 integrally formed with the second engagement part 62 is pushed to the rear side in the Y-direction against the biasing force of the biasing member.

As a result, the cap 61 is guided by a rail not shown or the like to rise upward to a position at which the ink discharge surface 411 of the print head 41 is covered, so that the ink discharge surface 411 is capped by the cap 61. That is, the function exercised state in which a set function that the cap 61 caps the ink discharge surface 411 is exercised is brought about.

Furthermore, when the first engagement part 421 of the mobile object (the print head 41 and the head holder 42 that supports the print head 41) and the second engagement part 62 of the cap mechanism 6 are disengaged from each other, so that a state pressed by the mobile object is relieved, the cap 61 is pushed back to the initial position by the biasing member not shown, and lowers again to the position at which the print head 41 is not interrupted.

The structure in which the cap 61 is movable vertically between the height position at which the print head 41 is not interrupted and the height position at which the ink discharge surface 411 of the print head 41 is covered is not limited to that illustrated herein.

On a side of the finger fixing part 3 on the base board upper plate 11 and on the opposite side of the home position Ar2, the maintenance area Ar3 in which maintenance of the print head 41 is performed is provided.

In the present embodiment, the left side in the X-direction in the device serves as the maintenance area Ar3. The maintenance area Ar3 should only be located within a range where the print head 41 (the head holder 42 that holds the print head 41) is moved by the head moving mechanism 49, and may be on the right side in the X-direction in the device, for example.

In the maintenance area Ar3, the maintenance mechanism 7 that performs maintenance of the ink discharge surface 411 of the print head 41 is provided.

In the present embodiment, a plurality of maintenance operations are performed in the maintenance mechanism 7. Specifically, the maintenance mechanism 7 is provided with a purger 71 that performs purge (spit) processing and a wiper 72 that wipes the ink discharge surface 411.

Figure 5:
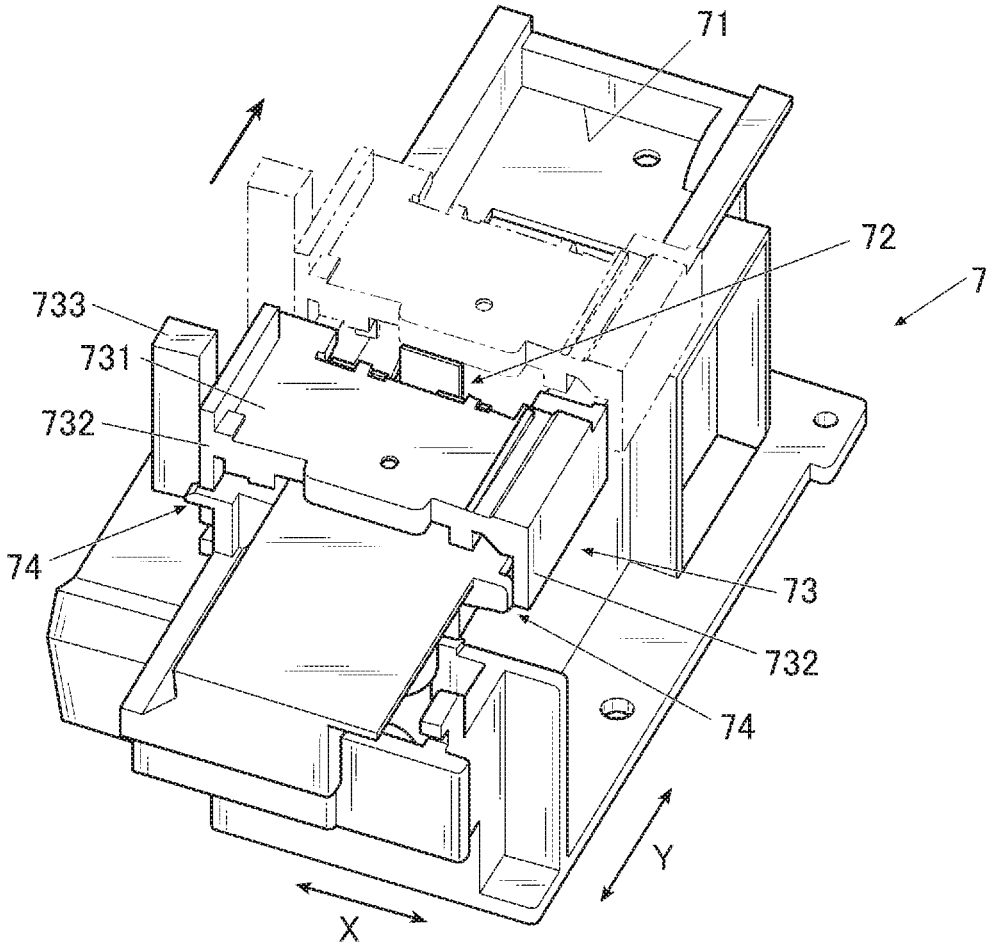
FIG. 5 is a perspective view showing a structure of a maintenance mechanism in the present embodiment.

FIG. 5 is a perspective view showing the maintenance mechanism 7 in the present embodiment. In FIG. 5, the initial state (standby state) is shown by solid lines, and the function exercised state in which a set function which will be described later is exercised is shown by chain double-dashed lines.

The specific arrangement of the purger 71 and the wiper 72 is not limited to the illustrated example, but, for example, the purger 71 and the wiper 72 may be positioned oppositely in the Y-direction, or the purger 71 and the wiper 72 may be arranged at a distance in the X-direction rather than in the Y-direction, or may be arranged at a distance both in the X-direction and the Y-direction.

The purger 71 receives ink forcibly discharged from the ink discharge surface 411 in what is called purge processing of causing ink to be forcibly discharged through the nozzle discharge ports 412 formed in the ink discharge surface 411 of the print head 41 to eject air, impurities, highly viscous ink, and the like in an ink flow passage such as the nozzle to the outside together with ink.

By performing the purge processing, clogging occurred in the nozzle of the print head 41 or the like is resolved, and a favorable discharge state is restored.

Figure 9:
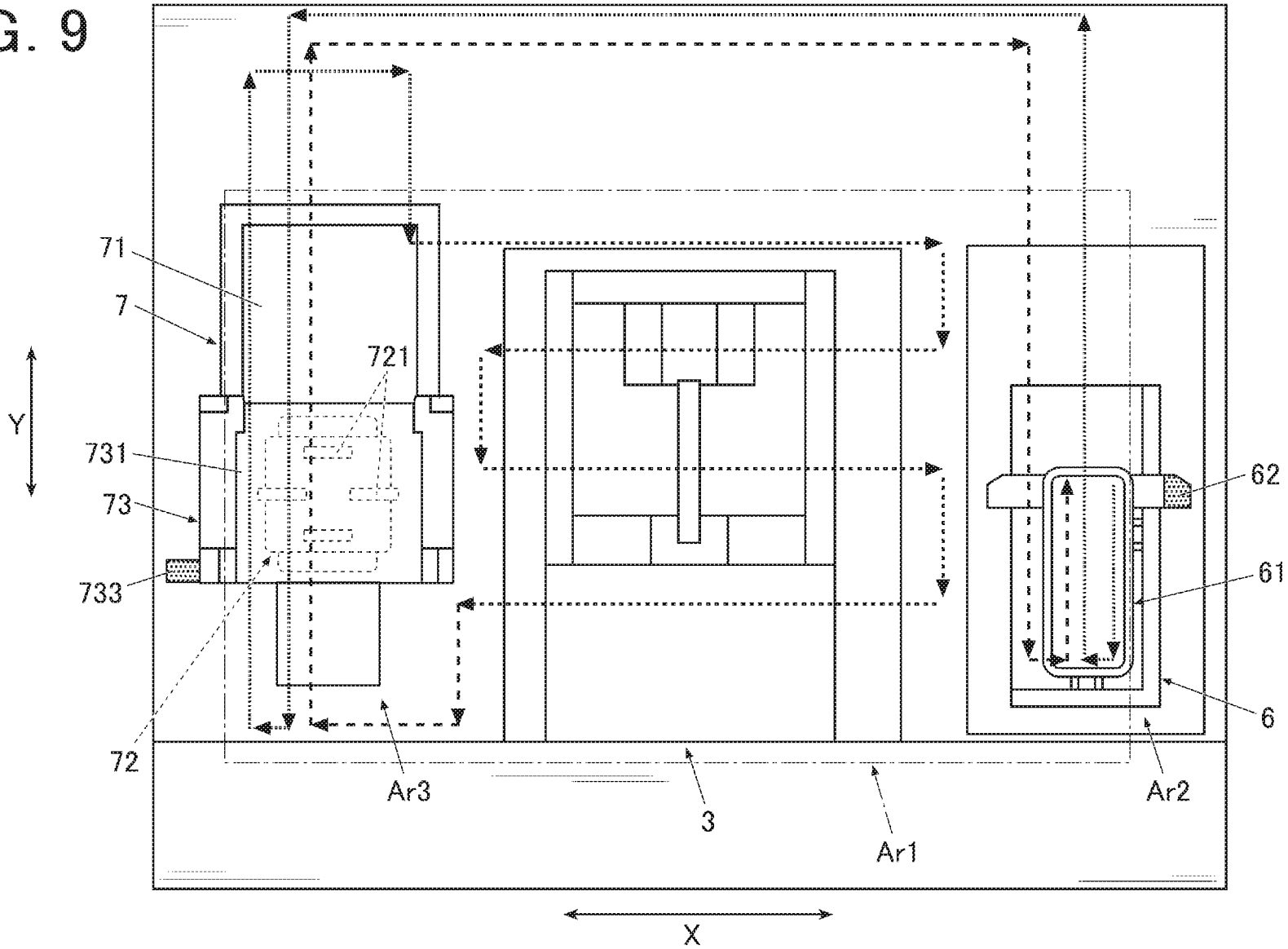
FIG. 9 is a plan view showing movement of a mobile object on a base board in the present embodiment.

The wiper 72 is to clean the ink discharge surface 411 on the lower surface of the print head 41 by wiping, and has a plurality of wiping members 721 (see FIG. 6) provided vertically (see FIG. 2 and FIG. 9). In the present embodiment, four wiping members 721 are arranged at a distance in a zigzag manner. The arrangement, size, provided number, and the like of the wiping members 721 are not limited to those of the illustrated example.

The wiping member 721 is a cleaning blade that wipes ink or the like adhering to the ink discharge surface 411, and is made of an elastic material such as rubber, for example. The wiping member 721 is preferably made of a corrosion-resistant material that is less likely to cause corrosion or the like even in repeated contact with ink.

The wiping member 721 or the wiper 72 as a whole may be a removable, exchangeable component.

The wiping member 721 is a plate-like member flattened in the X-direction perpendicular to the Y-direction in a case where the moving direction of the print head 41 when passing through the wiper 72 is the Y-direction, and is formed at such a position and a height that the leading end (upper end) of the wiping member 721 comes into contact with the ink discharge surface 411 when the print head 41 passes above the wiper 72.

The wiping member 721 bows flexibly in accordance with the movement of the print head 41, and brings the leading end portion into sliding contact with the ink discharge surface 411 to remove ink and the like adhering to the ink discharge surface 411 (the nozzle discharge ports 412 provided in the ink discharge surface 411).

When the ink discharge surface 411 of the print head 41 is wiped, ink adheres to the leading end portion of the wiping member 721 and the like.

Thus, in the present embodiment, a scraper 73 that removes ink adhering to the wiping member 721 is provided as shown in FIG. 5 and the like.

The scraper 73 includes a plate-like main body 731.

The maintenance mechanism 7 is provided with two guide rails 74 extending in the Y-direction. Latches 732 that latch onto the two guide rails 74 are provided on both sides in the X-direction of the main body 731. With the latches 732 latching onto the guide rails 74, the main body 731 is movable in the Y-direction in a sliding manner.

In this manner, the main body 731 of the scraper 73 is a second movable portion, and the main body 731 is movable in the front-rear direction (that is, the Y-direction) of the device which is a movable direction.

The main body 731 is arranged at a low position to such a degree that its upper surface does not come into contact with the lower surface (that is, the ink discharge surface 411) of the print head 41.

On the inner side of the main body 731, that is, on the surface on the side opposed to the wiping member 721, a scraping member not shown that comes into sliding contact with the wiping member 721 to scrape ink adhering to its leading end and the like is provided. The material, shape, and the like of the scraping member are not particularly limited, but anything that can remove ink adhering to the wiping member 721 may be used.

In the present embodiment, when in the initial state (standby state) (the state shown by solid lines in FIG. 5, for example), the main body 731 is biased toward the front side in the Y-direction by the biasing member (not shown) having a spring or the like. The main body 731 is arranged to cover the wiper 72 at this position.

Figure 6:
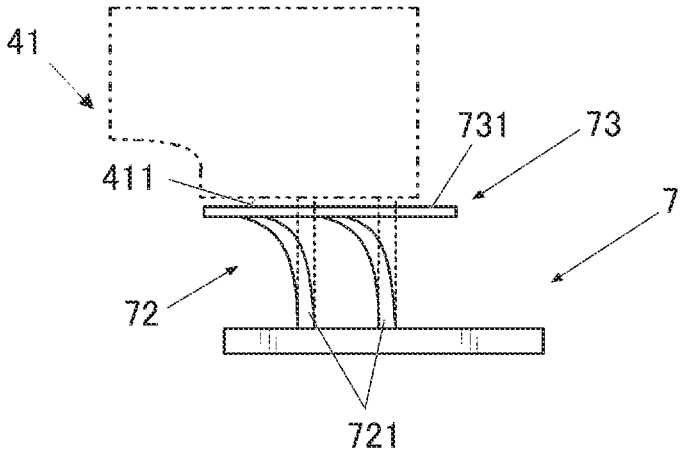
FIG. 6 is an explanatory diagram schematically showing a positional relationship between a wiper, a scraper, and the print head.

FIG. 6 is an explanatory diagram schematically showing a positional relationship between the wiper, the main body of the scraper, and the print head.

In the present embodiment, the maintenance mechanism 7 including the wiper 72 is arranged on the left side of the finger fixing part 3 in a manner that at least a portion enters the printing area Ar1 of the print head 41 (see FIG. 7 to FIG. 9). Thus, the width in the X-direction and the width in the Y-direction of the entire device are made more compact than in a case where the maintenance mechanism 7 is arranged at a position completely falling out of the printing area Ar1. On the other hand, in a state where the wiper 72 is exposed, the wiping member 721 will come into contact with the ink discharge surface 411 of the print head 41 in a printing operation, which may block the printing operation.

Therefore, in the present embodiment, the main body 731 of the scraper 73 is arranged at a position at which the wiper 72 is covered as shown in FIG. 6 when it is not necessary to wipe the ink discharge surface 411, such as during a printing operation. Accordingly, the wiper 72 is neither exposed nor brought into contact with the ink discharge surface 411.

In an unrestricted state, the wiping member 721 has its leading end located at a position higher than the position at which the main body 731 is arranged as shown in FIG. 6 by the broken lines. Thus, when the main body 731 is arranged above the wiper 72, the wiping member 721 has its leading end elastically deformed into a bent state, as shown by the solid lines in FIG. 6. Accordingly, the leading end of the wiping member 721 does not come into contact with the ink discharge surface 411 when the print head 41 moves to a position above the wiper 72. As shown in FIG. 6, the upper surface of the main body 731 of the scraper 73 is also arranged at a position lower than the ink discharge surface 411 of the print head 41. Accordingly, the scraper 73 neither comes into contact with the ink discharge surface 411 nor interrupts the printing operation performed with the print head 41.

When the main body 731 moves to a position at which the wiper 72 is not covered, the wiping member 721 returns to the original state, so that the ink discharge surface 411 can be wiped.

The main body 731 is integrally provided with a second engagement part 733 to be engaged with the first engagement part 421 outside the printing area Ar1. The first engagement part 421 is provided on the head holder 42 of the print head 41 which is a mobile object.

In the present embodiment, the second engagement part 733 is provided on the left side in the X-direction on the main body 731 and on the near side of the device, in a manner protruding upward. In a case where the maintenance mechanism 7 is arranged on the right side in the X-direction oppositely to the present embodiment, the second engagement part 733 is also provided on the right side in the X-direction on the main body 731.

As described earlier, in the standby state, the main body 731 of the scraper 73 covers the wiper 72, so that the wiper 72 is not exposed, and the leading end of the wiping member 721 neither comes into contact with the print head 41 during a printing operation nor interrupts the movement of the print head 41 or the printing operation.

Even when moving in the Y-direction, the print head 41 (the head holder 42 that holds the print head 41) which is a mobile object does not run into the second engagement part 733 as long as the first engagement part 421 substantially as a whole is present within the printing area Ar1 (see the left side in FIG. 7, for example).

When the print head 41 (the head holder 42 that holds the print head 41) which is a mobile object moves in the left direction along the X-direction which is the first direction, and moves from the front side toward the rear side in the Y-direction which is the second direction crossing the first direction in a state where at least the first engagement part 421 substantially as a whole is located outside the printing area Ar1 (in the present embodiment, on the left side in the X-direction with respect to the printing area Ar1), the first engagement part 421 runs into the second engagement part 733 to be brought into the engaged state (see the left side in FIG. 8, for example).

When the print head 41 (the head holder 42 that holds the print head 41) further moves to the rear side (in the direction shown by an arrow in FIG. 5) along the Y-direction which is the second direction while maintaining this engaged state, the second engagement part 733 of the scraper 73 of the maintenance mechanism 7 which is a functional component is pressed toward the rear side in the Y-direction. Accordingly, the main body 731 of the scraper 73 integrally formed with the second engagement part 733 is pushed to the rear side in the Y-direction against the biasing force of the biasing member.

As a result, the main body 731 is guided by the guide rails 74, and moves in the Y-direction with the scraping member of the scraper 73 being in sliding contact with the leading end of the wiping member 721, to perform a scraping operation. When the scraper 73 moves to the rear side of the device, the wiper 72 is exposed. Accordingly, the leading end of the wiping member 721 abuts on the ink discharge surface 411 of the print head 41 moving above the wiper 72, and the function exercised state in which a set function of wiping the ink discharge surface 411 with the movement of the print head 41 is exercised is brought about.

In the present embodiment, the purger 71 is arranged on the rear side in the Y-direction with respect to the wiper 72, and when the print head 41 (the head holder 42 that holds the print head 41) which is a mobile object further presses the scraper 73 to the rear side so that the scraper 73 moves to the rear side with respect to the purger 71, a purge operation is performed in the purger 71.

When the first engagement part 421 and the second engagement part 733 are disengaged from each other, the scraper 73 returns to the initial position (in the present embodiment, the position shown by the solid lines in FIG. 5) by means of the biasing force of the biasing member.

The nail printing device 1 additionally includes a control device that controls each part of the device, or the like, illustration or the like of which is omitted.

A behavior of the nail printing device 1 which is the printing device in the present embodiment will now be described.

FIG. 9 is a schematic plan view showing an arrangement of respective components when the base board 10 is seen from above. In FIG. 9, illustration of part of the X-direction moving mechanism 45, the print head 41, and the Y-direction moving mechanism 47 is omitted.

In FIG. 9, an area enclosed by a dash-dot-dash line on the base board 10 is the printing area (operation area) Ar1. In the example shown here, the home position Ar2 at which the cap mechanism 6 is provided is located on the right side in the X-direction of the printing area Ar1, and the maintenance area Ar3 in which the maintenance mechanism 7 is provided is located on the left side of the printing area Ar1.

FIG. 9 is an explanatory diagram representing a sequence of the printing operation of the print head 41, and shows moving paths of the print head 41 (and the head holder 42) which is a mobile object moved by the head moving mechanism 49 by dashed arrows and the like as appropriate.

Specifically, an "outward path" on which the print head 41 (and the head holder 42) moves from the state waiting at the home position Ar2 to the maintenance area Ar3 to undergo maintenance, and then performs the printing operation is shown by smaller dot lines. A "return path" on which the print head 41 moves to the maintenance area Ar3 after the printing operation is terminated to undergo maintenance, and then returns to the home position Ar2 again is shown by larger dot lines. Arrows on the respective smaller dot lines and larger dot lines each show a moving direction of the print head 41 (and the head holder 42).

In the present embodiment, the printing area (operation area) Ar1 is a range where the print head 41 and the head holder 42 that holds the print head 41 can move during the printing operation. The printing area Ar1 is set considering the widths in the front-rear and left-right directions of the print head 41 and the head holder 42 (the maximum width at which each end of the print head 41 and the head holder 42 can be positioned during the printing operation), and is an area wider than the opening 33 at which the nail which is a printing target is located and exposed, as described earlier.

Before the printing operation is started, the print head 41 held by the head holder 42 is located at the home position Ar2, and in a state capped by the cap mechanism 6.

When the printing operation is started, the print head 41 (and the head holder 42) once moves to the front side in the Y-direction as shown by the smaller dot lines on the right side in FIG. 9, and then moves to a position not engaged with the second engagement part 62 in the left direction along the X-direction. Accordingly, the first engagement part 421 and the second engagement part 62 of the cap mechanism 6 are disengaged from each other. Accordingly, the cap 61 is lowered to a low position which is the standby state by means of the biasing force of the biasing member, so that the capped state of the print head 41 is released.

Thereafter, the print head 41 (and the head holder 42) moves to the rear side of the device along the Y-direction. At this time, the print head 41 moves above the cap mechanism 6, but the ink discharge surface 411 does not come into contact with the cap 61 since the cap 61 is at a sufficiently low position.

The print head 41 (and the head holder 42) further moves to the left side on the rear side of the device along the X-direction.

When arriving at a rear position in the maintenance area Ar3, the print head 41 (and the head holder 42) moves to the front side of the device along the Y-direction. At this time, the maintenance mechanism 7 is in the standby state in which the main body 731 of the scraper 73 covers the wiper 72, and the print head 41 (and the head holder 42) moves without coming into contact with the wiping member 721 or the like.

When arriving at the front side of the device, the print head 41 (and the head holder 42) then moves to the left side in the X-direction to a position at which at least the first engagement part 421 provided on the left side of the head holder 42 is located outside the printing area Ar1.

When arriving at the position at which the first engagement part 421 falls out of the printing area Ar1, the print head 41 (and the head holder 42) moves as it is to the rear side in the Y-direction. Accordingly, the first engagement part 421 runs into the second engagement part 733 provided on the scraper 73, so that the first engagement part 421 and the second engagement part 733 are engaged with each other.

When the print head 41 (and the head holder 42) further moves to the rear side in the Y-direction while maintaining this engaged state, the main body 731 of the scraper 7 is pushed to the rear side in the Y-direction to bring about the state in which the wiping member 721 is exposed from the state in which the main body 731 covers the wiping member 721 of the wiper 72, and the function exercised state in which a wiping operation is performed is brought about.

When the print head 41 (and the head holder 42) further moves to the rear side in the Y-direction in this state, the wiping member 721 comes into sliding contact with the ink discharge surface 411 of the print head 41, and the ink discharge surface 411 is wiped (wiping operation). When the wiping operation is terminated, the print head 41 (and the head holder 42) moves again to the front side in the Y-direction.

The point of time when it is considered that the wiping operation is terminated is set as appropriate. For example, the wiping operation may be terminated when the ink discharge surface 411 makes a passage to the rear end in the Y-direction of the wiper 72. The wiping operation may be terminated when the ink discharge surface 411 passes above the wiper 72 a predetermined number of times.

Furthermore, control may be exerted so as to vary the number of wiping operations in accordance with a state of the ink discharge surface 411 estimated from a time elapsed after a point of time when a previous wiping operation is performed, for example.

The print head 41 (and the head holder 42) further moves to the rear side in the Y-direction while pushing the scraper 73 until the main body 731 of the scraper 7 is located on the rear side with respect to the purger 71 arranged on the rear side of the wiper 72 (the rear side in the Y-direction), and the ink discharge surface 411 of the print head 41 is located above the purger 71.

Then, after purging is performed in the purger 71, the print head 41 (and the head holder 42) moves in the right direction along the X-direction to a position not engaged with the second engagement part 733 of the scraper 7. Thereby the first engagement part 421 and the second engagement part 733 of the scraper 7 are disengaged from each other. There is no more pressing force exerted by the first engagement part 421, and the main body 731 of the scraper 7 moves to the front side in the Y-direction by means of the biasing force of the biasing member to be brought into the standby state in which the wiper 72 is covered again.

Thereafter, the print head 41 (and the head holder 42) is located at the printing original position (in the present embodiment, within the printing area Ar1 and around the corner position on the left rear side of the finger fixing part 3 in FIG. 9). At this time, since the wiper 72 is covered by the main body 731 of the scraper 73, the wiping member 721 will not come into contact or the like with the ink discharge surface 411 even when the ink discharge surface 411 passes above the wiper 72.

The print head 41 (and the head holder 42) performs printing on the nail while reciprocating from the printing original position multiple times (in FIG. 9, moving four times in the left-right direction within the printing area Ar1). In a case of performing maintenance of the ink discharge surface 411 again on the return path after printing is terminated, the print head 41 (and the head holder 42) once moves to the front side in the Y-direction until being positioned on the front side with respect to the main body 731 of the scraper 73, as shown by the larger dot lines.

Thereafter, the print head 41 (and the head holder 42) moves to the left side in the X-direction to a position at which at least the first engagement part 421 is located outside the printing area Ar1, and moves to the rear side along the Y-direction. Accordingly, the first engagement part 421 and the second engagement part 733 are engaged with each other, and the main body 731 of the scraper 73 is moved to expose the wiper 72 to bring about the function exercised state, similarly to the case of the outward path.

Then, when the print head 41 (and the head holder 42) moves above the wiper 72, the wiping member 721 comes into sliding contact with the ink discharge surface 411 to perform the wiping operation. When the wiping operation is terminated, the print head 41 (and the head holder 42) further moves to the rear side in the Y-direction, and when arriving at a position above the purger 71, the purge operation is performed in the purger 71 as appropriate.

Thereafter, the print head 41 (and the head holder 42) moves to the right side in the X-direction to a position at which the first engagement part 421 and the second engagement part 733 are disengaged from each other.

The print head 41 (and the head holder 42) then moves to the right side in the X-direction to the rear side of the home position Ar2, and thereafter moves to the front side in the Y-direction.

When arriving at the front side in the Y-direction, the print head 41 (and the head holder 42) moves to the right side in the X-direction to the position at which at least the first engagement part 421 provided on the right side of the head holder 42 is located outside the printing area Ar1.

When arriving at the position at which the first engagement part 421 falls out of the printing area Ar1, the print head 41 (and the head holder 42) moves to the rear side again along the Y-direction.

Accordingly, the first engagement part 421 runs into the second engagement part 62 provided on the cap 61, so that the first engagement part 421 and the second engagement part 62 are engaged with each other.

When the print head 41 (and the head holder 42) further moves to the rear side in the Y-direction while maintaining this engaged state, the cap 61 is pushed to the rear side in the Y-direction against the biasing force of the biasing member to rise gradually, so that the function exercised state in which the cap 61 caps the ink discharge surface 411 of the print head 41 is brought about.

In the present embodiment, the sequence of the above-described printing operations is performed when performing printing on a single nail, and in a case of performing printing on all the nails of fingers of one hand, or the like, for example, the series of operations are repeated for each finger. It is not essential to perform this sequence each time when performing printing on a single nail.

The sequence shown in FIG. 9 and the present embodiment is an example, and the order of the maintenance operation and the moving paths of the print head 41 (and the head holder 42) may be set as appropriate.

For example, the maintenance operation may only include purging or may only include wiping. Specific details of the maintenance operation may be determined as appropriate in accordance with the amount of printing, printing time, or the like, or may be changed between the outward path for performing the printing operation and the return path for returning to the home position Ar2 after the printing operation.

As described above, according to the present embodiment, the printing operation is performed with movement within the set printing area Ar1, and the holder 42 that holds the print head 41 having the first engagement part 421 protruding from the outer periphery, the head moving mechanism 49 that moves the holder 42, and the maintenance mechanism 7 and the cap mechanism 6 are provided. The maintenance mechanism 7 and the cap mechanism 6 have the scraper 73 and the cap 61, respectively. The scraper 73 and the cap 61 are provided with the second engagement parts 731 and 62, respectively, to be engaged with the first engagement part 421. The maintenance mechanism 7 and the cap mechanism 6 each have at least a portion located within the printing area Ar1, and may take the standby state and the function exercised state in which the set function is exercised. When the first engagement part 421 and the second engagement parts 731, 62 are engaged with each other outside the printing area Ar1, and the holder 42 moves in a set direction in the engaged state, at least a part of the maintenance mechanism 7 and the cap mechanism 6 moves to bring the maintenance mechanism 7 and the cap mechanism 6 into the function exercised state.

Thus, a part of the functional components is moved with the first engagement part 421 and the second engagement parts 62, 733 being engaged with each other, and the functional components are operated with a simple structure.

Since at least a part of the functional components such as the cap mechanism 6 and the maintenance mechanism 7 is located in the printing area Ar1 before moving, the respective functional components are arranged compactly within the device. Accordingly, the device is reduced in size as a whole. Furthermore, moving lines when performing capping and the maintenance operation for the print head 41 are minimized, so that printing is performed efficiently.

In the present embodiment, the head moving mechanism 49 is a two-axis moving mechanism that moves the print head 41 (and the head holder 42) which is a mobile object in the X-direction which is the first direction and the Y-direction which is the second direction crossing this first direction. When the print head 41 (and the head holder 42) moves in the X-direction, the first engagement part 421 and the second engagement parts 62, 733 are brought into the engaged state, and when the print head 41 (and the head holder 42) moves in the Y-direction while maintaining the engaged state, the functional components are brought into the function exercised state.

In this manner, since the two-axis head moving mechanism 49 necessary for the printing operation is utilized to cause each of the functional components to function, the functional components are operated with a simple structure without the need to mount a moving mechanism separately.

In the present embodiment, the mobile object includes the print head 41, and the functional components include at least either of the maintenance mechanism 7 that performs maintenance of the ink discharge surface 411 of the print head 41 and the cap mechanism 6 that protects the ink discharge surface 411 of the print head 41 from drying.

Thus, operations necessary for maintenance of the ink discharge surface 411, capping of the ink discharge surface 411, and the like are performed utilizing the structure indispensable for the printing operation.

Accordingly, various operations necessary for protecting the ink discharge surface 411 are achieved while minimizing the device structure.

Although an embodiment of the present invention has been described above, the present invention is not limited to such an embodiment, but can be modified variously within the scope of the invention.

For example, the present embodiment has described as an example the purger 71 that causes ink to be forcibly discharged in an operation similar to normal ink discharge, but the purger 71 is not limited to this structure.

For example, a purger of a type that includes a small pump or the like, and upon bringing the ink discharge surface 411 into a sealed state, sucks ink, impurities, and the like remaining in the nozzle or the like by means of the pump to be forcibly discharged to the outside may be provided.

The present embodiment has described as an example the case in which the maintenance mechanism 7 has the purger 71 and the wiper 72, but the type of maintenance parts provided for the maintenance mechanism 7 are not limited to them. Other maintenance parts may be provided instead of the purger 71 and the wiper 72.

As another maintenance part, for example, a component in which an absorbing member made of a highly absorptive material such as felt is pressed against the ink discharge surface to absorb or adsorb ink or the like adhering to the ink discharge surface for removal may be provided.

The present embodiment has described as an example the case in which the first engagement part 421 runs into the second engagement part 733 to be brought into the engaged state, and the main body 731 of the scraper 73 covers or exposes the wiping member 721 of the wiper 72 while maintaining this engaged state in accordance with the movement of the print head 41 (the head holder 42 that holds the print head 41) in the movable directions (that is, the functional component is brought into the function exercised state and the standby state), but this is not a limitation.

For example, a latch mechanism or the like may be provided which, when the main body 731 moves to the farthest side in the Y-direction in a movable portion where the main body 731 can move while maintaining the engaged state of the first engagement part 421 and the second engagement part 733, the scraper 73 is latched in the state where the main body 731 is located on the farthest side in the movable portion, and when the first engagement part 421 further runs into the second engagement part 733 again, the latched state is relieved.

In the case of such a structure, after bringing the scraper 73 into the latched state by the latch mechanism, the functional component is maintained in the function exercised state even when the first engagement part 421 moves to the position at which the engaged state with the second engagement part 733 is relieved, so that the moving line during maintenance or the like is configured more flexibly.

A similar latch mechanism or the like that maintains the latched state until the first engagement part 421 runs into the second engagement part again may be provided on the home position Ar2 side.

The present embodiment has described as an example the structure in which, when the print head 41 (the head holder 42 that holds the print head 41) moves from the front side in the Y-direction to the rear side, the first engagement part 421 runs into the second engagement part 733 to be brought into an engaged state, and the functional component is brought into the function exercised state by moving the print head 41 (the head holder 42 that holds the print head 41) while maintaining this engaged state, but the operation for bringing the functional component into the function exercised state is not limited to the example described herein.

Figure 10A:
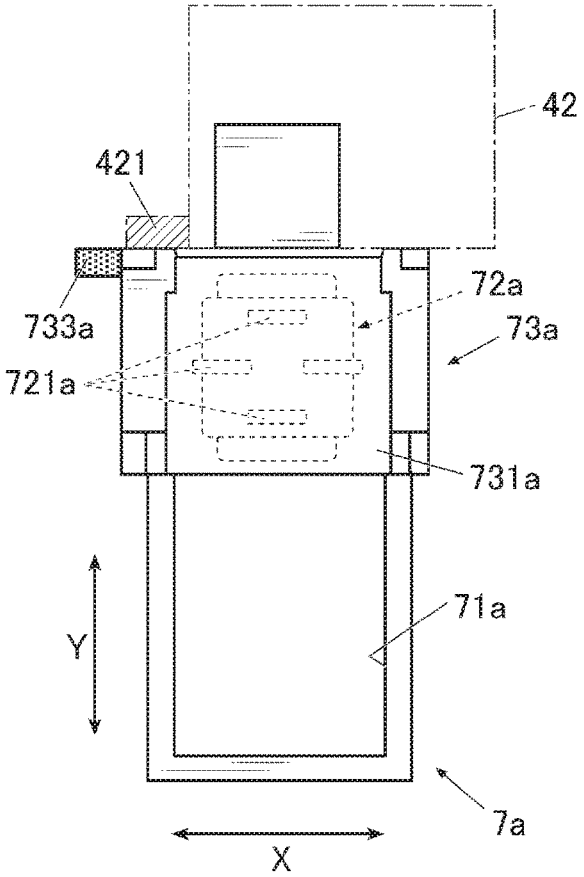
FIG. 10A is a schematic diagram showing a variation of the present embodiment, and shows a case in which the wiper is in a standby state.
Figure 10B:
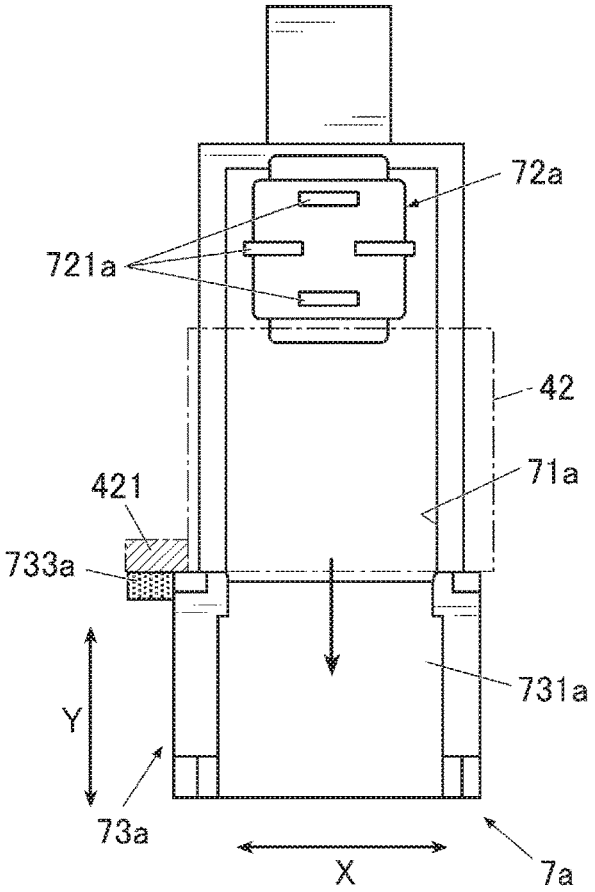
FIG. 10B is a schematic diagram showing a variation of the present embodiment, and shows a case in which the wiper is in a function exercised state.

It should only be structured such that, when the mobile object moves in a predetermined direction in the state where the first engagement part 421 and the second engagement parts 62, 733 are engaged with each other outside the operation area (the printing area Ar1), the functional component may take the standby state and the function exercised state in which a set function is exercised, and a structure as shown in FIG. 10A and FIG. 10B, for example, may be adopted.

That is, in a case where the maintenance mechanism 7*a* has the purger 71*a* arranged on the front side in the Y-direction oppositely to the present embodiment, and includes the wiper 72*a* including the wiping member 721*a* on the rear side in the Y-direction with respect to the purger 71*a*, for example, the print head 41 (the head holder 42 that holds the print head 41) approaches the scraper 73*a* from the rear side in the Y-direction, as shown in FIG. 10A.

Then, the first engagement part 421 moves to the left side in the X-direction until running into the second engagement part 733*a*, and after the first engagement part 421 runs into the second engagement part 733 to be brought into the engaged state, the main body 731*a* of the scraper 73*a* is moved from the rear side in the Y-direction toward the front side as indicated by an arrow in FIG. 10B. Accordingly, the wiper 72*a* is brought into the function exercised state, so that the wiping operation for the ink discharge surface 411 is performed.

When the wiping operation is terminated, the print head 41 (and the head holder 42) moves further to the front side in the Y-direction. When arriving at a position above the purger 71, the purge operation is performed in the purger 71 as appropriate.

A structure similar to that shown in FIG. 10A and FIG. 10B may be adopted for the cap mechanism 6 located at the home position Ar2.

That is, a structure may be adopted in which, when the print head 41 (the head holder 42 that holds the print head 41) moves from the rear side in the Y-direction to the front side, the first engagement part 421 runs into the second engagement part 62 to be brought into the engaged state, and when the print head 41 (the head holder 42 that holds the print head 41) moves further to the front side of the device along the Y-direction while maintaining this engaged state, the cap mechanism 6 which is a functional component is brought into the function exercised state.

The present embodiment has described as an example the case in which the functional components are the maintenance mechanism 7 that performs maintenance of the ink discharge surface 411 of the print head 41 and the cap mechanism 6 that protects the ink discharge surface 411 of the print head 41 from drying, but both of them may not be provided.

Another functional component may be provided additionally.

The present embodiment has described as an example the case in which a mobile object having the first engagement part 421 is the head holder 42 that holds the print head 41, but the first engagement part 421 should only be provided on a mobile object movable in the X-direction (first direction) and the Y-direction (second direction), which is not limited to the head holder 42.

The first engagement part 421 may be provided on the print head 41, for example.

In a case where the mobile object includes the print head 41, the first engagement part 421 is moved by the moving mechanism that moves the print head 41 indispensable for the printing operation.

The present embodiment adopts the structure in which the nail printing device 1 performs printing in the ink jet system, but the technique with which the nail printing device 1 performs printing is not limited to the ink jet system.

For example, a pen holder that holds a pen for printing that performs printing with the pen tip kept in contact with the nail surface may be provided, and printing may be performed using the pen. Alternatively, a structure provided with both printing means of an ink jet system as in the present embodiment and a pen holder that holds a pen for printing to perform printing using the plurality of types of printing means may be adopted.

In the present embodiment, the nail printing device 1 may constitute a printing system in conjunction with an external terminal device or the like, and may be configured to, after input of a printing start instruction, detection of a printing area (that is, the nail area), various types of correction, generation of printing data, and the like are performed on the terminal device side, perform a printing operation of performing printing on the nail on the nail printing device 1 side.

Image data about a nail design may be stored in a memory of the terminal device, or may be stored in a memory of the nail printing device 1.

It may be configured such that image data about a nail design may be stored in a server device or the like connectable via a network or the like, and the terminal device or the nail printing device 1 makes access to the server device or the like to refer to the image data about the nail design.

This enables a selection of a design to be printed from among a larger number of nail designs.

The nail printing device 1 may be provided with a dryer including a heater or a fan for drying ink after printing.

For example, by providing the finger waiting part 120 or the like with the dryer, a printed nail is dried while printing is being performed on the nail of another finger, which shortens the time required for nail printing.

Although some embodiments of the present invention have been described above, the scope of the present invention is not limited to the above-described embodiments, but includes the scope of the invention recited in the appended patent claims and the scope of equivalents thereof.

What is claimed is:

1. An electronic apparatus comprising:

a mobile object that performs a set printing operation on a printing medium;

a moving mechanism that moves the mobile object;

a functional mechanism that takes:

a standby state in which the functional mechanism does not interrupt the printing operation of the mobile object; and a function exercised state in which (i) at least a part of the functional mechanism is located within a printing operation area where the mobile object can move while the mobile object performs the printing operation and (ii) a set function is exercised; and a transition member which is located outside the printing operation area and which is movable to bring the functional mechanism into the function exercised state from the standby state, wherein:

the mobile object moves while being in contact with the transition member outside the printing operation area so that the transition member moves to bring the functional mechanism into the function exercised state from the standby state, the mobile object comprises a contact member, the mobile object moves along a movable direction of the transition member in an abutting state where the contact member of the mobile object comes in contact with the transition member outside the printing operation area, so that the transition member moves to bring the functional mechanism into the function exercised state from the standby state, the moving mechanism is a two-axis moving mechanism that moves the mobile object in a first direction and a second direction that crosses the first direction and agrees with the movable direction of the transition member, the contact member of the mobile object comes outside the printing operation area as the mobile object moves in the first direction, the mobile object moves in the second direction outside the printing operation area and the contact member of the mobile object is brought into contact with the transition member so that the contact member and the transition member are brought into the abutting state, and the mobile object moves further in the second direction while maintaining the abutting state so that the functional mechanism is brought into the function exercised state from the standby state.

2. An electronic apparatus comprising:

a mobile object that performs a set printing operation on a printing medium;

a moving mechanism that moves the mobile object;

a functional mechanism that takes:

a standby state in which the functional mechanism does not interrupt the printing operation of the mobile object; and a function exercised state in which (i) at least a part of the functional mechanism is located within a printing operation area where the mobile object can move while the mobile object performs the printing operation and (ii) a set function is exercised; and a transition member which is located outside the printing operation area and which is movable to bring the functional mechanism into the function exercised state from the standby state, wherein:

the mobile object moves while being in contact with the transition member outside the printing operation area so that the transition member moves to bring the functional mechanism into the function exercised state from the standby state, the mobile object comprises a contact member, the mobile object moves along a movable direction of the transition member in an abutting state where the contact member of the mobile object comes in contact with the transition member outside the printing operation area, so that the transition member moves to bring the functional mechanism into the function exercised state from the standby state, the printing operation area is located at a center of the electronic apparatus, and the functional mechanism is located within the printing operation area.

3. An electronic apparatus comprising:

a mobile object that performs a set printing operation on a printing medium;

a moving mechanism that moves the mobile object;

a functional mechanism that takes:

a standby state in which the functional mechanism does not interrupt the printing operation of the mobile object; and a function exercised state in which (i) at least a part of the functional mechanism is located within a printing operation area where the mobile object can move while the mobile object performs the printing operation and (ii) a set function is exercised; and a transition member which is located outside the printing operation area and which is movable to bring the functional mechanism into the function exercised state from the standby state, wherein:

the mobile object moves while being in contact with the transition member outside the printing operation area so that the transition member moves to bring the functional mechanism into the function exercised state from the standby state, the mobile object comprises a contact member, the mobile object moves along a movable direction of the transition member in an abutting state where the contact member of the mobile object comes in contact with the transition member outside the printing operation area, so that the transition member moves to bring the functional mechanism into the function exercised state from the standby state, and while the mobile object performs the set printing operation on the printing medium in the printing operation area, the mobile object performs the printing operation by moving in the printing operation area at a height where the mobile object does not come into contact with the functional mechanism.

4. An electronic apparatus comprising:

a mobile object that performs a set printing operation on a printing medium;

a moving mechanism that moves the mobile object;

a functional mechanism that takes:

a standby state in which the functional mechanism does not interrupt the printing operation of the mobile object; and a function exercised state in which (i) at least a part of the functional mechanism is located within a printing operation area where the mobile object can move while the mobile object performs the printing operation and (ii) a set function is exercised; and a transition member which is located outside the printing operation area and which is movable to bring the functional mechanism into the function exercised state from the standby state, wherein:

the mobile object moves while being in contact with the transition member outside the printing operation area so that the transition member moves to bring the functional mechanism into the function exercised state from the standby state, and the functional mechanism is integrally formed with the transition member.

* * * * *